United States Patent [19]

Britt et al.

[11] Patent Number: 4,782,363

[45] Date of Patent: Nov. 1, 1988

[54] COPYING SYSTEM FOR ON-LINE FINISHING

[75] Inventors: James E. Britt, Penfield, N.Y.; Charles W. Spehrley, Jr., White River Junction, Vt.; Brian F. Walsh, Etna; Robert G. Palifka, Oxford, both of N.H.; Charles E. Smith, Pittsford; Thomas Acquaviva, Penfield, both of N.Y.

[73] Assignee: Xerox Corporation, Stamford, Conn.

[21] Appl. No.: 98,096

[22] Filed: Sep. 17, 1987

[51] Int. Cl.[4] ..... G03G 15/00; B42B 2/09; B65H 31/24

[52] U.S. Cl. ..... 355/14 SH; 270/53; 271/287

[58] Field of Search ..... 355/3, 14, 24; 270/53, 270/58; 271/3.1, 287, 290, 292

[56] References Cited

U.S. PATENT DOCUMENTS

| | | | |
|---|---|---|---|
| 3,788,640 | 1/1974 | Stemmle | 271/64 |
| 3,848,868 | 11/1974 | Stemmle | 271/173 |
| 3,944,207 | 3/1976 | Bains | 270/58 |
| 3,997,263 | 12/1976 | Stemmle | 355/24 |
| 4,145,037 | 3/1979 | Mol | 270/58 |
| 4,156,133 | 5/1979 | Legg | 235/92 SB |
| 4,212,457 | 7/1980 | Guenther | 271/288 |
| 4,248,525 | 2/1981 | Sterrett | 355/14 SH |
| 4,278,344 | 7/1981 | Sahay | 355/14 SH |
| 4,285,591 | 8/1981 | Botte et al. | 355/14 C |
| 4,355,880 | 10/1982 | Stemmle | 355/3 SH |
| 4,361,320 | 11/1982 | Kikuchi et al. | 271/288 |
| 4,361,393 | 11/1982 | Noto | 355/3 SH |
| 4,385,827 | 5/1983 | Naramore | 355/14 SH |
| 4,411,515 | 10/1983 | Kukucka et al. | 355/14 SH |
| 4,468,114 | 8/1984 | Pels et al. | 355/14 R |
| 4,473,425 | 9/1984 | Baughman et al. | 271/225 |
| 4,558,942 | 12/1985 | Chiama | 355/14 SH |
| 4,561,772 | 12/1985 | Smith | 355/14 SH |
| 4,564,185 | 1/1986 | Hamlin et al. | 270/53 |
| 4,566,782 | 1/1986 | Britt et al. | 355/14 SH |
| 4,568,172 | 2/1986 | Acquaviva | 355/3 SH X |
| 4,586,640 | 5/1986 | Smith | 227/14 |
| 4,639,126 | 1/1987 | Bushaw et al. | 355/3 SH |

*Primary Examiner*—Donald A. Griffin

[57] ABSTRACT

Providing plural precollated sets of copies by plurally recirculating a set of documents and normally making two consecutive identical copies per document per circulation, at one-half the copying rate of the copier, feeding these pairs of identical copy sheets separately into two of only 3 (or 4) movable compiler bins, sequentially accumulating and stacking these copy sheets into completed, compiled, collated copy sheet sets in each of the two compiler bins, and then removing the sets one at a time for finishing, from the opposite side of the bins, and sequentially changing, for subsequent circulations of the sets of documents, which 2 of the 3 compiler bins are being fed pairs of copy sheets, and which compiler bin is not, so that a compiled set of copy sheets may be removed from its bin or left in awaiting finishing of a prior set without having any copy sheets fed into that bin, in coordination with and without interfering with said feeding and directing of other copy sheets into other compiler bins. Preferably two copy sheets are fed into the same compiler bin in directly immediate sequence (the second copy of one document and the first copy of the next document) to reduce the number of operations of the bin gates. When there are an odd number of documents, preferably three identical copies are made of each document in a final copying circulation of the document set and fed into all 3 bins, unless the copies are duplex and there are too many documents for plural duplex buffer sets.

26 Claims, 2 Drawing Sheets

COPYING SYSTEM FOR ON-LINE FINISHING

Figure 1:
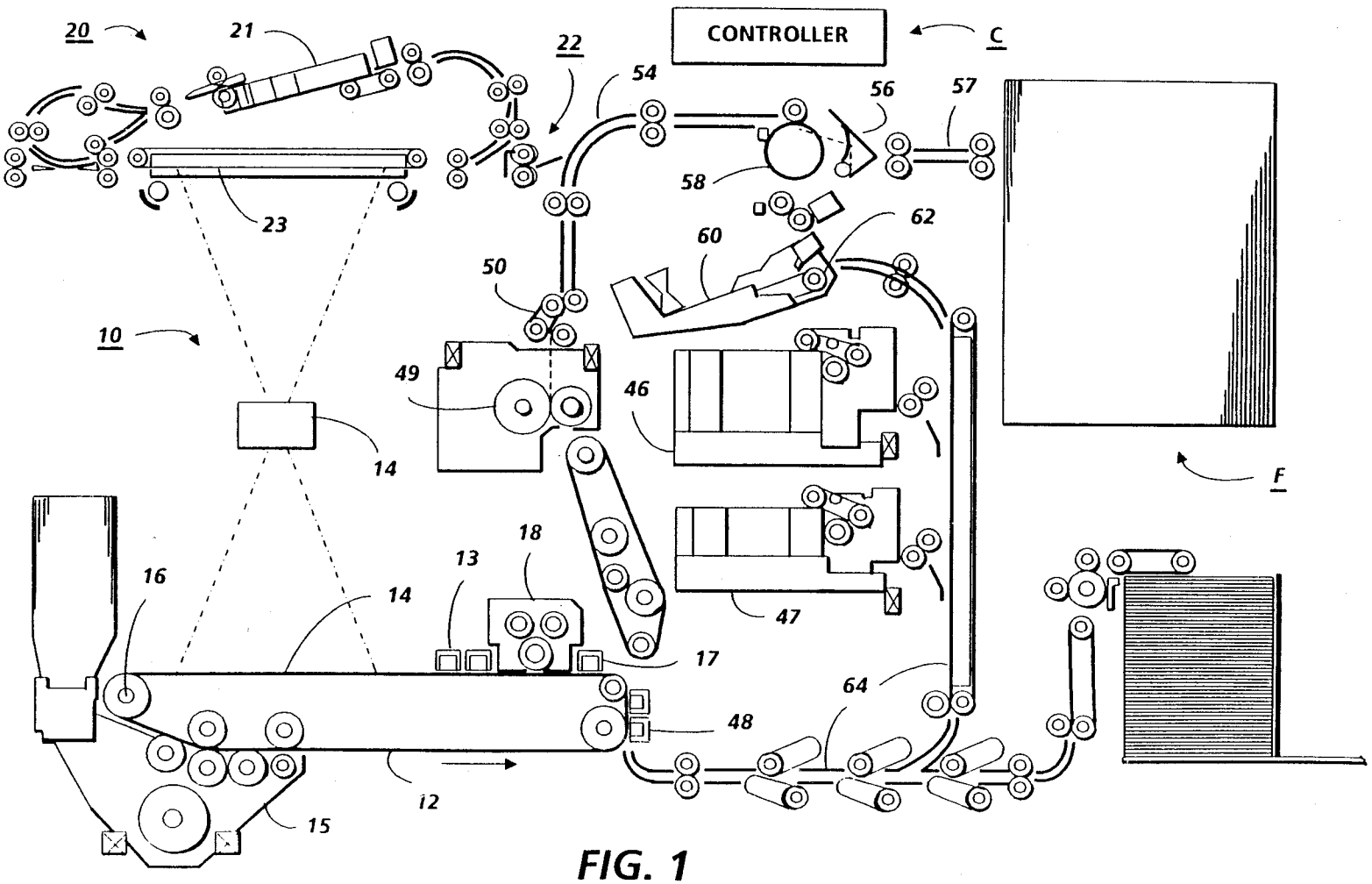

Hereby cross-referenced, and incorporated by reference, are the copending applications of the same assignee, U.S. Ser. Nos. 075,706 and 076,979 entitled "Stapling Apparatus" by Russell L. Phelps and "Sheet Stacking Apparatus" by Paul V. Sadwick and Michael K. Sabocheck, filed July 29, 1987 and July 23, 1987, respectively.

The present invention relates to improved precollation copying for producing precollated copy sets at the full copying rate of a high speed copier but with reduced document recirculations and reduced document feeding velocities and with improved on-line finishing compatibility. Disclosed therefore is a "dual flash" multiple recirculating document copying system, as defined hereinbelow, with triple or single flash alternatives in certain cases, together with a three bin compiler system with alternating bin pairs loading an unloading, to optimize copying efficiency.

By way of important background art, a "dual flash"-/dual output tray concept was first briefly noted in a Research Disclosure Publication No. 19015, February 1980, p. 61, entitled, "Duplex copying system" (but for use in immediate duplex document handling). Note especially the last paragraph. A prior Xerox Corporation U.S. Pat. No. 3,997,263 issued Dec. 14, 1976 to D. J. Stemmle had disclosed dual output trays for a precollation copier, and noted the possibility of on-line finishing, but did not describe or show how to do so, and this was not a dual flash system, it was a single copy per document pass alternate direction (1-N then N-1) documents on scroll scanning system. "Dual flash" for special cases in precollation duplex copying is noted for example in U.S. Pat. No. 4,561,772 issued Dec. 31, 1985 to Charles E. Smith. U.S. Pat. No. 4,639,126 issued Jan. 27, 1987 to K. A. Bushaw, et al. (IBM) discloses a dual flash paired buffer set duplex precollation copying system.

Of particular interest is a detailed "dual flash" precollation copying system with an integrated dual bin on-line finisher unit and an RDH input covered in Xerox Corporation U.S. Pat. No. 4,566,782 issued Jan. 28, 1986 to J. Britt et al,; and also covered in somewhat similar Xerox Corporation U.S. Pat. No. 4,558,942 issued Dec. 17, 1985 to Bernard Chiama. (Said R.D. Publication No. 19015 is cited in both.) Noted particularly is the copy entry and copy set removal from opposite sides of both of the dual bins disclosed in these two later patents, and other features of interest to and/or generically claiming features disclosed herein.

In a "dual flash" system, two copies are made of each document in each circulation of the document set, and alternatively separated in their outputs, to produce two precollated copy sets at a time from each document set circulation rather than the usual one. The tem "dual flash" generally refers to two directly successive exposures of the same document to make two identical copies. Scanning exposure can be used instead of flash exposure.

However, with only two compiler bins, as in said two above patents, the RDH and all copying must stop and wait after each pair of copy sets is completed until both sets have been removed from their bins. However, the second copy set cannot be removed from its bin until after the first set is finished unless there are two finishers, which is very undesirable, or a separate extractor and wait station is provided for the second set. This lowers productivity, especially for large numbers of small sets (which is a common copier/duplicator job) or for slow on-line finishings such as thermal edge strip glue binding. [E.g., U.S. Pat. No. 3,847,718 issued Nov. 12, 1974 to D. W. Watson; and U.S. Pat. No. 3,928,118 issued Dec. 23, 1975 to R. J. Kuhns.]

Another solution to high speed copying and on-line finishing is the multi-bin post-collation system of the Xerox "9900" duplicator, or the like as described, for example, in U.S. Pat. No. 4,361,393, issued Nov. 30, 1982 to F. A. Noto; and U.S. Pat. No. 4,411,515 issued Oct. 25, 1983 to W. P. Kukucka, et al. However, this is a large and expensive system, requiring a large number of bins for handling a significant number of copies efficiently. The substantial, and varying number of copy sets being made per document set circulation increases the complexity of copying, finishing, and job recovery in the event of a jam. With such a post-collation multibin system a copy run exceeding the total number of bins can cause long delays in waiting for a number of previously loaded bins to be unloaded and finished before the additionally required copy sets can be made and loaded into bins.

Xerox Corporation U.S. Pat. No. 4,385,827 filed Apr. 15, 1981 and issued May 31, 1983 to Raymond Naramore has a particularly relevant disclosure, and applicable generic claims coverage, to input sheet transport means on one side of an array of sheet collecting bins, and an output set transport on the opposite side of that bin array for transporting the collated sets for binding, and means for moving the bin array relative to the set transport for controlling the loading of copy sheets in the bin array simultaneously with the unloading of the copy sets therefrom. As indicated at Col. 5 in this disclosed embodiment the sheet input tranport is a vertical downwardly moving belt transport from which sheets are deflected into a bin by a deflector or gate associated with each of the bins. However, as explained in Col. 1 and at the bottom of Col. 5 and elsewhere, this is a post-collation system embodiment, like the above noted U.S. Pat. No. 4,361,393, not a precollation system. There are a multiplicity of bins, and "The number of bins utilized should correspond to the number of sheets in the paper path when the system has been programmed for the duplex mode . . . ."

Conventional multibin postcollation sorters in which the bins move up and down as a unit have been known for many years per se. E.g., the Xerox Corporation "4500" copier sorter, show for example in U.S. Pat. No. 3,788,640 issued Jan. 29, 1974 to D. J. Stemmle. Also noted re a post-collation moving bin array, with seperate copy sheet loading and finishing set removal systems is U.S. Pat. No. 4,564,185 issued Jan. 14, 1986 to T. J. Hamlin. A choice of stapling or glue binding finishing modes is also provided. However, this is a large rotating bin array. Other dual finishing mode finishers are noted, for example, in Xerox Corporation U.S. Pat. No. 4,586,640 by Charles E. Smith; and Kodak PCT/US83/00800 published Dec. 8, 1983, (priority U.S. Ser. No. 380,966, May 24, 1982).

Although the normal mode of operation here is dual flash precollation copying, there is also disclosed herein a precollation but variable flash system of mode selection for productivity optimization of a copier/duplicator. It preferrably utilizes a known programmable controller programmed with an analytical program or algorithms, whereby inputs such as the number of copy sets selected to be made, the number of sheets in the document set, and whether they are duplex or simplex, and odd or even in number, and whether duplex or simplex output is selected, are analyzed in respect to alternatives available in a particular machine structure and operation, to select the most efficient mode of machine operation to attain the output sought, and to operate the machine accordingly. Uncollated output may be optionally selected and will cause different sequencing.

Of background interest in that regard, J. Guenther, U.S. Pat. No. 4,212,457 issued July 15, 1980 is programmed to select between precollation or post-collation (multi-bin) modes, depending on the number of copy sets desired. The use of variable plural flash copying cycles for small numbers of original documents in precollation copying with only one compiler is taught, for example in U.S. Pat. No. 4,468,114 to S. J. Pels, et al, issued Aug. 28, 1984. The machine in A. J. Botte, et al., U.S. Pat. No. 4,285,591 issued Aug. 25, 1981 (IBM), is programmed to automatically segment the collator job when the number of document sets desired exceeds the capacity of the collator. U.S. Pat. No. 4,156,133 issued May 22, 1979 to E. L. Legg has variable operating programs for specific copy runs.

Of particular interest to the system of a variable number of plural duplex tray precollated buffer sets disclosed herein is Xerox Corporation U.S. Pat. No. 4,278,344 issued Dec. 17, 1985 to R. B. Sahay.

The present system comprises a collating and finishing apparatus and method comprising a buffered design to allow more time to finish a copy set without halting the copying. In a pre-collation copying mode, two bins at a time are utilized as the buffer for compiling while one or two other bins are awaiting being emptied for finishing, and then they function as the buffer for the next two copy sets, etc.

The following additional references were noted by way of background pertaining to collators and finishers. U.S. Pat. No. 4,361,320 to Kikuchi et al discloses a sheet distributing apparatus comprising a plurality of bins divided into two groups which are utilized alternatively when the number of copies to be collated exceeds the number of bins available. This allows an operator to remove collated copies from one group of bins while copies are being collated in the other group of bins (see, e.g., Col. 2, lines 13–21). This is for a post-collation system, without an RDH. U.S. Pat. No. 3,944,207 to Bains, Xerox Corporation entitled "Limitless Sorter", discloses a sorter comprising collating bins that are operable to open for releasing collated sheets into collating bins, and stapling, thus enabling uninterupted collating cycles. U.S. Pat. No. 4,145,037 to Mol discloses a vertical collator-sorter comprising a conveyor system for moving sheets and removable deflectors for deflecting sheets from the conveyor to bins, means for collating or sorting and means to eject sheets. U.S. Pat. No. 4,248,525 to Sterrett (Kodak) discloses a programmable apparatus for producing sets of copies from a set of document sheets, some of which copies can be produced in an RDH pre-collating mode by means of a recirculating feeder and others cannot be produced in a collating mode. The copies that are produced in a non-collating mode are stored temporarily. Programming controls the making of copies in a collating mode and the delivery of copies temporarily stored so that the copies arrive at a receiver or finisher in collated sets of copies with the page order of the copy sets corresponding to the page order of the document set. A copy storage section 14 has a plurality of deflectors 96 for deflecting copy sheets into temporary storage bins 82. Copy sheets are then delivered from the bins 82 to a finisher 16. U.S. Pat. No. 3,848,868 to Stemmle, Xerox Corporation, discloses a sheet sorting apparatus for collating both simplex and duplex copies comprising an inverter 13 in the copy sheet output path in the sorter module upstream of a vertical transport from which the copy sheets are deflected into sorter bins.

In general, as xerographic and other copiers increase in speed, and become more automatic, it is increasingly important to provide higher speed yet more reliable and more automatic handling of the document sheets being copied, i.e. the input to the copier. It is desirable to feed, accurately register, and copy document sheets of a variety or mixture of sizes, types, weights, materials, conditions and susceptibility to damage, yet with minimal document jamming, wear or damage by the document transporting and registration apparatus, even if the same documents are automatically fed and registered repeatedly, as is particularly needed for recirculating document precollation copying. This is a highly desirable feature for copiers. The art of original document sheet handling for copiers has been intensively pursued in recent years. Various systems have been provided for automatic or semiautomatic feeding of document sheets to and over the imaging station of the copier for copying. The documents are normally fed over the surface of an imaging station comprising a transparent platen, into a registered copying position on the platen, and then off the platen.

It is desirable for document handlers to be able to automatically feed documents as fast as they can be copied by the copier for enabling the full utilization or productivity of higher speed copiers. However, this is very difficult with higher speed copiers. Although automatic feeding and registration of each document at the correct position on the platen to be copied is highly desired, this is difficult to accomplish at high speeds (high document recirculation rates).

One document handling difficulty is skewing (rotating) the document and/or damaging the edge of the document, particularly as it is being stopped from a high speed. Other problems are related to the fact that documents can vary widely in sheet size, weight, thickness, material, condition, humidity, age, etc. Documents may even have curls, wrinkles, tears, "dog-ears", cut-outs, overlays, tape, paste-ups, punched holes, staples, adhesive or slippery areas, or other irregularities. Unlike sets of copy sheets, which generally are all from the same new clean batches and therefore of almost exactly the same condition and size, documents often vary considerably even if they are all of the same "standard" size, (e.g. letter size, legal size, A4, B4, etc.). In contrast, documents even in the same set may have come from completely different paper batches or have variably changed size with different age or humidity conditions, etc. Furthermore, the images on documents and their fusing can change the sheet feeding characteristics. These images may even be subject to damage in feeding if not properly handled, e.g. smearing of fresh ink. Yet it is desirable to rapidly feed, register and copy even a mixture of sizes, types, and conditions of documents without document jams or document damage and with each document correctly and accurately aligned to a desired registration position.

The present system enables the documents to be fed, registered and recirculated at only one-half the copying rate of the copier, with minimal productivity loss, and coordination with on-line finishing. This greatly alleviates the above and other document feeding difficulties and/or enables faster precollation copying.

In the description herein the terms "document" or "sheet" refer to a usually flimsy sheet of paper, plastic, or other such conventional individual image substrate, and not to microfilm or electronic images which are generally much easier to manipulate. It is important to distinguish copiers with physical document sheet recirculators from electronic copying systems, such as the Xerox "9700" printer, which can read and store page images of documents electronically and can reorder and represent them at will and without delays; and create copies (called prints) by writing the page images on a photoreceptor with a laser beam, or the like, since they do not have the problems with physical sheet documents.

However, much of the present system has utility in such copying systems also, since such "printers" are often very similar to other copiers except for the Electronic Front Ends (EFE) and therefore are included under the term "copier" herein unless indicated otherwise, such as by reference to documents.

The "document" here is the sheet (original or previous copy) being copied in the copier onto the outputted "copy sheet", or "copy". Related plural sheets of documents or copies are referred to as a "set". A "simplex" document or copy sheet is one having an image and page on only one side or face of the sheet, whereas a "duplex" document or copy sheet has a "page", and normally an image, on both sides. The "copy" may have an electronically modified or merged image, e.g., a highlight color overlay or insert.

The present invention is particularly suitable for precollation copying, i.e. automatically plurally recirculated document set copying provided by a recirculating document handling system or "RDH", although is also compatible with nonprecollation or postcollation copying. Precollation, collation, recirculative, or RDH copying, as it is variably called, is a known desirable feature for a copier. It provides a number of important known advantages. In such precollation copying any desired number of collated copy sets or books may be made by making a corresponding number of recirculations of the set of documents in collated order past the copier imaging station and copying each document page (normally only once) each time it circulates over the imaging station. The copies therefrom may automatically exit the copier processor in proper order for stacking as precollated sets, and thus do not normally require subsequent seperation and collation in a sorter or collator. On-line finishing (stapling or stitching and/or gluing or other binding) and/or removal and stacking and offsetting of completed but unfinished copy sets may thus be provided while further collated copy sets are being made in further circulations of the same document set.

Some examples of Xerox Corporation U.S. RDH Patents for precollation copying systems are U.S. Pat. No. 4,459,013 issued July 10, 1984 to T. J. Hamlin et al, U.S. Pat. No. 4,278,344 issued July 14, 1981 to R. B. Sahay, and U.S. Pat. Nos. 4,579,444, 4,579,325 or 4,579,326. Some other examples of recirculating document handlers are disclosed in U.S. Pat. Nos. 4,076,408; 4,176,945; 4,428,667; 4,330,197; 4,466,733 and 4,544,148. A preferred vacuum corrugating feeder air knife, and a tray, for an RDH are disclosed in U.S. Pat. Nos. 4,418,905 and 4,462,586. An integral semi-automatic and computer form feeder (SADH/CFF), which may be an integral part of an RDH, as noted in Col. 2, paragraph 2, therein, is disclosed in U.S. Pat. No. 4,462,527. Various others of these patents, such as U.S. Pat. No. 4,176,945 above, issued Dec. 4, 1979 to R. Holzhauser (Kodak) teach plural mode, e.g. RDH/SADH, document handlers.

However, a disadvantage of such precollation copying systems is that the documents must all be repeatedly separated and circulated sequentially for copying in a predetermined order, normally by a number of circulations equivalent to the total desired number of copy sets. Thus, greatly increased document handling is necessitated for a precollation copying system, as compared to a post collation copying system. Therefore, maximizing document handling automation while minimizing document wear or damage is particularly important in precollation copying.

In contrast, in a postcollation copying system, such as with an ADH or SADH, multiple copies may be made at one time from each document page and collated by being placed in multiple separate sorter bins. Thus, the document set need only be manually or semiautomatically fed to the imaging station once, if the number of copy sets being made is less than the number of available sorter bins. However, a disadvantage is that the number of copy sets which can be made in one document set circulation is limited by the number of available sorter bins. Also, a multi-bin sorter adds space and complexity and is not well suited for on-line finishing. However, postcollation copying, or even manual document placement, is desirable in certain special copying situations to minimize document handling, particularly for delicate, valuable, thick or irregular documents, or for a very large number of copy sets. Thus, it is desirable that a document handler for a precollation copying system be compatible with, and alternatively usable for, postcollation and manual copying as well.

The present invention overcomes various of the above-discussed problems and provides various of the above-discussed and other features and advantages.

A feature of the specific embodiment disclosed herein is to provide an improved copying system for providing multiple precollated sets of copies from a recirculated set of documents, comprising:

document recirculation and copying means for plurally recirculating a set of documents and normally making 2 (first and second) consecutive identical copies (copy sheets) therefrom per document per one said circulation of said document set, compiler means having only 3 or 4 compiler bins for sequentially accumulating and stacking copy sheets into completed compiled collated copy sheet sets in respective said compiler bins, removal means for removing said completed collated copy sheet sets from said compiler bins, copy sheet directing means for feeding and directing each of said 2 identical copy sheets seperately into only 2 of said 3 or 4 compiler bins for one said copying circulation of the set of documents, and control means controling said copy sheet directing means for sequentially changing, for subsequent circulations of the set of documents, which 2 of said compiler bins are so fed and are so accumulating said 2 identical copy sheets, and which other said compiler bin is not, said sequential changing occuring in coordination with said completions of accumulations of collated copy sheet sets, so that said removal means may remove an accumulated precollated set of copy sheets from at least one of said compiler bins while that compiler bin is not having a copy sheet fed thereinto, in coordination with and without interfering with said feeding and directing of other said copy sheets into other said compiler bins.

Further features provided by the system disclosed herein, individually or in combination, include those wherein: there are only three said compiler bins in said compiler means, comprising first, second, and third compiler bins, and said copy sheet directing means are operated by said control means so that in one said circulation of the set of documents said first copies are accumulated in said first bin and said second copies are accumulated in said second bin and no copies are accumulated in said third bin; and so that for a subsequent said document set circulation said first copies are placed only in said second bin and said second copies are placed only in said third bin and a completed collated set of copies is removed from said first bin; and so that for another said subsequent document circulation said copies are placed only in said first and second bins again, and so that this sequencing is repeated until a selected total number of precollated sets of copies is produced; wherein normally said copy sheet directing means and said control means feeds into the same compiler bin, in directly immediate sequence, said second copy of one document and said first copy of the next document, to reduce the number of operations of said copy sheet directing means; wherein, when there are an odd number of said documents in said document set, said document recirculation and copying means and said copy sheet directing means and said control means are operated to make three identical copies of each document in a final copying circulation of said document set and to feed and direct each of said 3 identical copy sheets seperately into each of 3 said compiler bins; wherein the set of documents to be so copied by said document recirculation and copying means is so circulated thereby at approximately one-half the rate of said copying of said documents; wherein the copy sheets are fed and directed into one side of said compiler bins by said copy sheet directing means, and are removed from another side of said compiler bins by said removal means so that said copy sheet directing means and said removal means are not operating on the same sides of said compiler bins and not interferring with one another; wherein if the copies being made are duplex copies, and an odd number of copy sets are selected to be made from the document set, and three times the number of documents in the document set would exceed a preset number corresponding to a maximum desired number of copy sheets in a duplex buffer tray, then on the final copying circulation of the document set said control means provides that only one copy is made of each document and these copies are fed and directed into only one said compiler bin; or wherein if the copies being made are duplex copies, and the number of documents in the document set would exceed a preset number corresponding to a maximum desired number of copy sheets in a duplex buffer tray, then said control means provides that only one copy is made of each document in each circulation of the document set and these copies are fed and directed into only one said compiler bin. Further features disclosed herein include an improved copying method for providing multiple precollated sets of copies from a multiply recirculated set of documents, comprising:

normally making 2 (first and second) consecutive identical copies (copy sheets) per document per circulation of said document set, feeding and directing each of said 2 identical copy sheets seperately into only 2 of only 3 compiler bins per said copying circulation of the set of documents, sequentially accumulating and stacking said copy sheets into two completed compiled collated copy sheet sets in said two compiler bins, removing one said completed collated copy sheet set from one said compiler bin without interfering with said feeding and directing of other said copy sheets into two other said compiler bins, and wherein said three compiler bins comprise first, second, and third compiler bins, and in one said circulation of the set of documents said first copies are accumulated in said first bin and said second copies are accumulated in said second bin and no copies are accumulated in said third bin and for a subsequent said document set circulation said first copies are placed only in said second bin and said second copies are placed only in said third bin and a completed collated set of copies is removed from said first bin and for another said subsequent document circulation said copies are placed only in said first and second bins again, and this sequencing is repeated until a selected total number of precollated sets of copies is produced; wherein normally said second copy of one document and said first copy of the next document feed into the same compiler bin, in directly immediate sequence, to reduce the number of operations of copy sheet directing; wherein, when there are an odd number of said documents in said document set, three identical copies are made of each document in a final copying circulation of said document set and fed separately into each of 3 said compiler bins; or wherein the set of documents being copied is circulated at approximately one-half the rate of copying of said documents; wherein the copy sheets are fed into one side of said compiler bins, and are removed from the opposite side of said compiler bins, so that said copy sheet accumulating and said copy set removing are occuring simultaneously from opposite sides of said compiler bins without interferring with one another; or wherein if the copies being made are duplex copies, and the number of documents in the document set would exceed a preset number corresponding to a maximum desired number of copy sheets in a duplex buffer tray, then only one copy is made of each document in each circulation of the document set and these copies are fed and directed into only one said compiler bin; or wherein while one completed and removed copy set is being finished, as by glue binding or the like, another copy set remains in one compiler bin waiting to be removed and finished while two other copy sets are being made and accumulated in the other two compiler bins; or wherein if the copies being made are duplex copies, and if the number of documents in the document set does not exceed a preset maximum desired number, then plural pairs of one-sided buffer set copies are repeatedly made from one side of the documents and placed in a duplex buffer tray and then copied on their other sides from the other sides of the documents.

Further features disclosed herein include an improved copying method for providing multiple collated copy sets from a multiply recirculated set of documents copied in precollated page sequential order in a copier, comprising normally making immediately sequential pairs of identical copies of each document in said precollated order and sequentially feeding them into an associated three bin finishing unit in precollated page sequential order; and normally stacking one of said pair of copies in one bin and the other in another bin; and, during the same time period, holding a previously stacked complete copy set, which is awaiting removal and finishing, in the other, third, bin, which is then serving as a buffer or waiting station; and meanwhile finishing another previously stacked and removed copy set in an associated set finisher; and alternating which bin so serves as said buffer or waiting station, and which two bins are so fed copy sheets for stacking, in coordination with said recirculations of the set of documents; wherein all said steps occur continuously and repeatedly without any delay or pause in copying at the full copying rate of the copier, and the set of documents are recirculated at one-half the full copying rate of the copier.

Further features disclosed herein include a specialized copying system for producing multiple finished collated copy sets by repeatedly generating copies in a copier in sequential page order sets, but normally generating two, and only two, identical copies per page at a time irrespective of the number of said multiple copy sets being made, and feeding said sequential page order pairs of copies separately to two bins of a finisher unit for removal therefrom and finishing of completed collated copy sets, the improvement for copying and finishing said collated copy sets at up to the full copying rate of the copier, comprising:

a movable bin unit with only three or four bins;

a single set removal means for removing a completed copy set for finishing from a bin which is adjacent said set removal means;

bin indexing means for indexing said movable bin unit so that said one side of a selected varying one of said three or four bins is positioned adjacent said set removal means; and bin loading and control means for sequentially feeding said copies into a selected, varying, pair of said bins, other than a bin from which a completed copy set is being removed, and from a different side of said bins, said bin loading means so feeding said copies into said selected pair of bins while another bin is awaiting or undertaking removal of a copy set by said set removal means, or while a copy set previously removed from another bin is being finished, or while said movable bin unit is being indexed by said indexing means, to avoid interruption of said generating of copies and said bin loading thereby; wherein said movable bin unit indexes vertically, said bin loading means moves said copy sheets vertically past one side of said bins and selectively deflects individual sheets into selected bins, and said set removal means moves substantially horizontally at one vertical level to remove copy sets from a bin indexed to said one vertical level.

Further features disclosed herein include a specialized copying method for producing multiple finished collated copy sets by repeatedly generating copies in a copier in sequential page order sets, but normally generating two, and only two, identical copies per page at a time irrespective of the number of said multiple copy sets being made, and feeding said sequential page order pairs of copies separately to two bins of a finisher unit for removal therefrom and finishing of completed collated copy sets, the improvement for copying and finishing said collated copy sets at up to the full copying rate of the copier, comprising:

feeding all said copies to a movable bin unit with only three or four bins;

removing a completed copy set for finishing from a bin at one position of one side of a bin;

indexing said movable bin unit so that said one side of a selected varying one of said three or four bins is positioned adjacent said one position; and sequentially feeding said copies into a selected, varying, pair of said bins other than a bin containing a completed copy set which has not yet been removed, and from a different side of said bins tjhan the side from which a completed copy set is being removed;

so feeding said copies into said selected pair of bins while another bin is awaiting or having removal of a copy set, or while a copy set previously removed from another bin is being finished, or while said movable bin unit is being indexed, to avoid interruption of said generating of copies and said bin loading thereby; wherein said copy sets may be so generated by recirculating a set of documents in a recirculating document handler at a recirculation rate which is half of said full copying rate; or wherein said movable bin unit index vertically, said copy sheets are moved vertically past one side of said bins and selectively deflected into said selected bins, and said completed copy sets are removed substantially horizontally at one vertical level from a bin indexed to said one vertical level.

Some examples of other prior art copiers with document handlers, and especially with control systems therefor, including operator console switch selection inputs, document sheet detecting switches, etc., are disclosed in U.S. Pat. Nos. 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270; and 4,475,156. It is well known in this art, and in general, how to program and execute document handler and copier control functions and logic with conventional or simple software instructions for conventional microprocessors in a copier controller. This is taught by the above and other patents and various commercial copiers. Such software may vary depending on the particular function and particular microprocessor or microcomputer system utilized, of course, but will be available to or readily programmable by those skilled in the applicable arts without experimentation from either descriptions or prior knowledge of the desired functions together with general knowledge in the general software and computer arts. It is also known that conventional or specified document and copy sheet handling functions and controls may be alternatively conventionally provided utilizing various other known or suitable logic or switching systems.

All references cited in this specification, and their references, are incorporated by reference herein where appropriate for appropriate teachings of additional or alternative details, features, and/or technical background.

Figure 2:
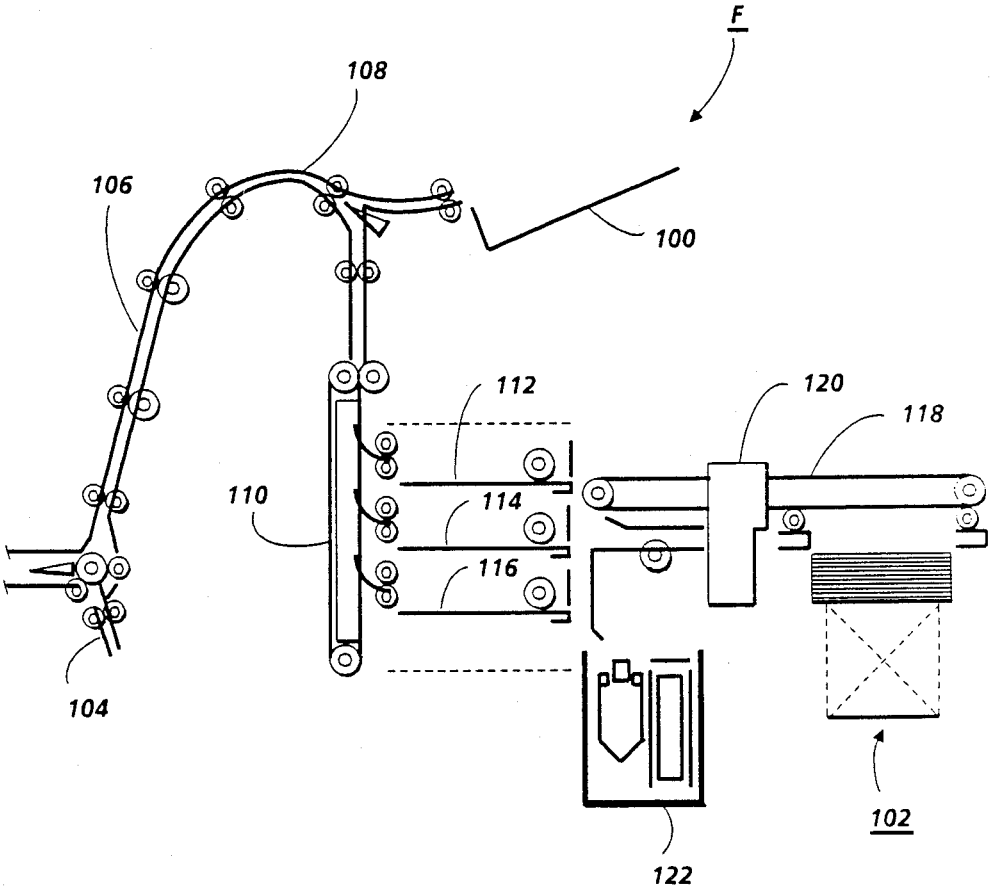

Various of the above-mentioned and further features and advantages will be apparent from the specific apparatus and its operation described in the example below. The present invention will be better understood by reference to this description of this embodiment thereof, including the drawing figures (approximately to scale), wherein:

FIG. 1 is a schematic front view of one example of the present invention incorporated into an exemplary xerographic copier and its associated exemplary document handler; and FIG. 2 is a schematic elevational view showing the finishing station of the FIG. 1 printing machine.

Describing now in further detail the specific example illustrated in the Figures, there is shown in FIG. 1 a copier 10 with a document handling system 20. Here this DH 20 is an RDH somewhat similar to that disclosed in U.S. Pat. Nos. 4,589,651 or 4,589,652 or 4,469,319, etc., for sequentially separating and transporting document sheets onto and over the conventional platen imaging station 23 of the copier 10, restacking them, and recirculating them. The document handling system 20 illustrated here is exemplary, and also may be modified for different copiers. Further descriptions of the particular RDH illustrated here are in U.S. Ser. Nos. 029,206 and 029,027 filed Mar. 23, 1987, but are not needed here. This RDH 20 has two separate document inputs, a recirculating or RDH input stacking and restacking tray 21 on top, and an SADH side entrance 22 for semiautomatic document handling, especially for larger documents, which may be optionally inserted short edge first there. This document recirculating handling system 20 here is adapted to automatically repeat the feeding and registering of a set of document sheets at the appropriate registration (copying) position on the platen 23, by repeatedly recirculating them without disturbing their page order. It also provides for inversion of duplex documents.

Other than the document handling system, the output and finishing system, and the controls to be described, the exemplary copier 10 shown in FIG. 1 is basically similar in paper paths and functions to the well known "Xerox" "1075" or "1090" xerographic copiers which provide automatic duplex precollation copying, as illustrated and described in patents cited above, including U.S. Pat. No. 4,278,344 and others.

The exemplary copier 10 of FIG. 1 will now be briefly described. The copier 10 conventionally includes a xerographic photoreceptor belt 12 and the xerographic stations acting thereon for respectively corona charging 13, image exposing 14, image developing 15, belt driving 16, precleaning discharge 17 and toner cleaning 18. Documents on the platen 23 maybe imaged onto the photoreceptor 12 through a variable reduction ratio optical imaging system to fit the document images to the selected size of copy sheets.

The control of all machine functions, including all sheet feeding, is, conventionally, by the machine controller "C". The controller "C" is preferably a known programmable microprocessor, exemplified by the previously cited art. The controller "C" conventionally controls all of the machine steps and functions described herein, and others, including the operation of the document feeder 20, all the document and copy sheet deflectors or gates, the sheet feeder drives, the finisher "F", etc.. As further taught in the references, the copier controller also conventionally provides for storage and comparison of the counts of the copy sheets, the number of documents recirculated in a document set, the desired number of copy sets and other selections and controls by the operator through the console or other panel of switches connected to the controller, etc.. The controller is also programmed for time delays, jam correction control, etc.. Conventional path sensors or switches may be utilized to help keep track of the position of the documents and the copy sheets and the moving components of the apparatus by connection to the controller. In addition, the controller variably regulates the various positions of the gates depending upon which mode of operation is selected.

The copier 10 is adapted to provide either duplex or simplex precollated copy sets from either duplex or simplex original documents presented by the RDH 20. Two separate copy sheet trays 46 and 47 are provided for feeding clean copy sheets from either one selectably. They may be referred to as the main tray 46 and auxiliary tray 47.

The copy sheets are fed from the selected one of the trays 46 or 47 to the transfer station 48 for the conventional transfer of the xerographic toner image of document images from the photoreceptor 12 to the first side of a copy sheet. The copy sheets are then fed by a vacuum transport to a roll fuser 49 for the fusing of that toner image thereon. From the fuser, the copy sheets are fed through a sheet decurler 50. The copy sheets then turn a 90° corner path 54 in the sheet path which inverts the copy sheets into a last-printed face-up orientation before reaching a pivotal decision gate 56. The image side which has just been transferred and fused is face-up at this point. If this gate 56 is down it passes the sheets directly on without inversion into the output path 57 of the copier to the finishing module "F". If gate 56 is up it deflects the sheets into a duplex inverting transport 58. The inverting transport (roller) 58 inverts and then stacks copy sheets to be duplexed in a duplex buffer tray 60.

The duplex tray 60 provides intermediate or buffer storage for those copy sheets which have been printed on one side and on which it is desired to subsequently print an image or images on the opposite side thereof, i.e. copy sheets in the process of being duplexed. Due to the sheet inverting by the roller 58, these buffer set copy sheets are stacked into the duplex tray 60 face-down. They are stacked in this duplex tray 60 on top of one another in the order in which they were copied.

For the completion of duplex copying, the previously simplexed copy sheets in the tray 60 are fed seriatim by its bottom feeder 62 back to the transfer station 48 for the imaging of their second or opposite side page image. This is through basically the same copy sheet transport path (paper path) 64 as is provided for the clean (blank) sheets from the trays 46 or 47. It may be seen that this copy sheet feed path 64 between the duplex tray 60 and the transfer station 48 has an inherent inversion which inverts the copy sheets once. However, due to the inverting transport 58 having previously stacked these buffer sheets printed face-down in the duplex tray 60, they are represented to the photoreceptor 12 at the transfer station 48 in the proper orientation, i.e. with their blank or opposite sides facing the photoreceptor 12 to receive the second side image. This is referred to as the "second pass" for the buffer set copies being duplexed. The now fully duplexed copy sheets are then fed out again through the fuser 49 and fed out into the output path 57.

The output path 57 here transports the printed copy sheets directly, one at a time, into the connecting, online, modular, finishing station module "F", shown in detail in FIG. 2. There the completed precollated copy sets may be finished by stapling, stitching, gluing, binding, and/or offset stacking. Suitable details are disclosed in the cited art, or other art, or in the applications cross-referenced hereinabove, and are further described hereinbelow with reference to FIG. 2.

Some additional examples of prior automatic on-line collating copier finishers (staplers, stitchers, gluers or other binders) and/or offsetters and their controls, besides those previously cited in the introduction, are disclosed in U.S. Pat. Nos. 3,630,607 issued Dec. 28, 1971 to H. Korn et al.; 3,793,016 issued Feb. 19, 1974 to R. N. Eichorn; 4,134,672 issued Jan. 16, 1979 to L. B. Burlew et al.; 4,328,919 issued May 11, 1982 to B. R. Lawrence et al.; 4,344,544 issued Aug. 17, 1982 to T. Cross; 4,398,986 issued Aug. 16, 1983 to Robert C. Smith et al; 4,516,714, issued May 14, 1985 to Oskar J. Brahm; 4,328,919 issued May 11, 1982; and "Research Disclosure Journal" publications Nos. 22733 and 22734 on pages 120–134 of the March 1983 issue (anonymous). Another copier on-line glue binder is disclosed in the Xerox Disclosure Journal Vol. 4, No. 4, p. 425, July 1979. These may be alternatively used with the disclosed system by, e.g., changing the activation times and activation rates as described herein for their compiler or accumulator binding operations. Other on-line stapling systems for multi-bin collation include Xerox Corp. U.S. Pat. No. 3,884,408 issued May 20, 1975 to L. L. Lieter, et al; and U.S. Pat. No. 4,087,087 issued May 2, 1978 to John H. Looney.

Copy sets can be forwarded out of the disclosed finisher on to additional finishing stations if desired. For example, to a hole puncher, ring binder, GBC binder, or the like.

Referring now to FIG. 2, the general operation of exemplary finishing station module "F" here will now be described. Certain sheet path similarities will be noted with the previously described operations of U.S. Pat. No. 4,385,827 by N. Naramore. Finishing station F receives fused copies from the copier (FIG. 1), compiles and finishes copy sets, and delivers them to the output sheet stacking apparatus, indicated generally by the reference numeral 102. Alternatively, it delivers copies to the top output tray 100. Sets of copy sheets delivered to output sheet stacking apparatus 102 are normally collated, but may be uncollated, and may be finished or unfinished. Unfinished sets may be offset. Finished sets may be stitched with one or two stitches. Finishing station F can also glue-bind sets and deliver stacks of bound sets to stacking apparatus 102.

The sheet path of finishing station F includes an inverter 104 driven by a reversible motor. The inverter has a solenoid actuated diverter gate that diverts sheets into the inverter, and a tri-roll nip that is used to drive sheets into and out of the inverter. It also has a compression spring which assists in reversing the direction of the sheets and assists in driving them out of the inverter.

Registration transport 106 is used to transport sheets from inverter 104 to output transport 108. Two cross roll registration nips are used to side register the sheets. The cross roll registration nips are driven by the sheet path drive motor. The output transport 108 is also driven by the sheet path drive motor. It transports sheets from the registration transport to a top tray gate where the sheets are diverted to either vacuum transport 110 or out into top tray 100.

Vacuum transport 110 is used to transport sheets from transport 108 to any selected one of three bins 112, 114 or 116. Bins 112, 114 and 116 are all used to compile and register sheets into completed copy sets. A separate gate (set of stripping fingers) is associated with each bin, as illustrated, to selectively deflect each sheet on the transport 110 into a selected bin 112, 114 or 116. A known in-bin scuffer wheel system may be provided as illustrated to maintain stacking registration. The set of compiler bins 112, 114, 116 are driven up and down as a ∓bindexer" unit (note the illustrated dashed-line positions) by a bidirectional bin drive motor adapted to position to proper bin at the bin unloading position. There a set unloading transport 118 may have, for example, a pair of set clamps mounted on two air cylinders and driven by four air valve solenoids. Two of the air valves are used for positioning the set transport and two are used for the retract function. The set transport 118 is used to transport sets from the bins to the stitcher 120, or binder 122, and to the sheet stacking apparatus 102. The stitched, bound, or unfinished sets are delivered to the stacking apparatus 102 where they are stacked for delivery to the operator.

Each bin preferrably has a registration gate or pair of vertical stops at the unload side thereof which is automatically pivoted out of the way after the set clamp of the unloading transport 118 has grasped that set, so as to allow the set removal from the bin by horizontal movement of the unloading transport 118.

Exemplary details of the other suitable copy set transports and finishing apparatus are described in references cited herein and elsewhere, including various means for reaching into a bin to grasp and remove a completed, compiled, collated, copy set therein.

Note that bin *un*loading desirably occurs at only one vertical position or level of the bins, to simplify set retrieval and finishing. Thus the bin set indexes up and down so as to place the bin containing the next completed set to be removed adjacent this unloading position, aligned with set unloading transport 118. But bin *loading* here can be done into any bin, in any position of the bins, and simultaneously with bin unloading. However, the controller inhibits loading of a bin in the process of being unloaded, or a bin already containing a completed copy set.

It is important to note that sheets can enter bins either above or below the set ejecting level, and on either the up or down movements of the bins, even though the bin entrance velocities of the sheets will vary depending on the bin movement relative to transport 110.

To summarize, all three compiler bins index up and down as a unit between 3 different unloading positions for unloading. Bin unloading of compiled sets is from a single vertically fixed position adjacent the downstreams sides of the bins. Each bin has its own independent gate, for variable loading. Incoming sheets are on the vertical sheet transport 110 moving by the copier sides of all the bins and their respective gates. There is no vertically fixed sheet entrance position and any bin can be loaded in any position of the bins. Thereby individual sheets can enter the bins either above or below the compiled set eject level (the unloading position), from the other side, and during both up and down cycles of the bins.

The copy set handling and input-output technology (IOT) described in this example is closely related to the finisher architecture. The disclosed finisher "F" has a "through the bins" architecture, and a small number of bins architecture, rather than a "9900" duplicator like architecture, (see, e.g., U.S. Pat. No. 4,361,393, supra) in which there are a large number of bins and the copy sets must be removed from the same side of the bins from which the copies are fed into the bins, so that these two functions interfere with one another and prevent bidirectional movement of the bins relative to the set removal means.

Here a dual flash operating system can provide full productivity, without any copier pitch skips, for multiplex simplex finished copy sets of three or more page document sets. It was discovered that three compiler bins was the minimum number required to support full system productivity with dual flashed 3 pitch sets. While the first of one pair of copy sets is being finished, the other set of that pair of copy sets can remain waiting to be finished in a bin, yet meanwhile the next pair of copy sets can be made and loaded into the two bins which are now empty. Then the second completed set can be removed and finished while the next pair of copy sets is being completed. Then one of the next pair of copy sets can be removed and finished while a third pair is started, and so on.

The sequences of feeding into and compiling copy sheets in said compiler bins and removing compiled collated copy sheet sets from said compiler bins of said compiler system desirably comprises sequences substantially as follows; where "A", "B" and "C" are designations for the respective first, second and third compiler bins, where "N" is the designation of the first copy sheet to be fed into a compiler bin of a total of N copy sheets in a collated copy sheet set to be compiled therein, where "1" is the last fed copy sheet of that copy set, where "- - -" represents the repetition and continuation of the associated sequence "N" to "1" between said first and last copy sheets of that sequence for that copy set, and where "{EJECT→}" represents the removing of that completed compiled collated copy set from that respective compiler bin by said removal means:

```
C
B        _N_ _N-1_                  ---
A _N_                  _N-1_                ---
C
B      ---_2_ _1_ {EJECT→}
A ---_2_              _1_ {EJECT→}
C        _N_ ---  _1_ {EJECT→}
B _N_  ---  _1_ {EJECT→}
A
```

In this above description the bins are referred to as A, B and C, rather than 112, 114, and 116, in order to emphasize that the sequence is not limited to that physical order. Each bin has its own integral gate, solinoid operable in any order programmed by the controller. Since the gates move with their bins but maintain interdigitation with the transport 110 belts, sheets can be loaded into bins in any bin position, and while the bins are moving.

Note that a typical bin LOADING order or sequence is A,B;B,A;A,B;B . . . etc., to completion of 2 sets, then C,B;B,C;C,B . . . etc. for the next two sets, as shown above, etc.. A typical repeating bin UNLOADING or eject order is B,A;B,C . . . etc., as shown above, or it could be A,B;C,B;A,B;C,B . . . etc. The first sheet of the next set enters a bin on the second pitch of an eject cycle.

The bin entry order is altered if required for the last pages so that the last pages of the 2 sets land in B then A if the unload order is to be B,A. They land in B then C if the unload order is to be B then C. Example: load the last 3 pairs of sheets in the order . . . A,B;B,A;B,A for an odd number of pages so that bin B will be ready to unload first. Thus, the first bin load order with the *first* two sheets is not important, but can be chosen for consistency. This key to productivity is that the first bin scheduled to be unloaded is loaded with the first one of the last two sheets of the two sets being completed. This enables an unload to start one pitch sooner.

A 4 bin design was developed as an alternative (although the 3 bin concept is more compact, simpler, and less costly, and is preferred). The 4 bin concept has some unique advantages such as allowing even number of copy jobs to close out with a quad flash sequence. However, its primary virtue is in better productivity with bound sets wherein a hot melt glue/tape finishing cycle is utilized which has a very long (such as about 30 pitches) finishing cycle compared to a stapling or stitching finishing cycle (e.g., 3 pitches). This allows the last pair of copies to be flashed and fed to 2 bins with 2 compiled but unremoved sets still in the other two bins waiting to be removed and bound or otherwise finished. A 4 bin system also supports a 3 flash closeout of odd run length jobs (an odd number of copy sets) in the same basic manner as a 3 bin system. A 4 bin finisher can also operate to provide a 4 flash (4 sheet, 4 bin) closeout of even copy jobs (as even number of selected copy sets) on a final document set circulation to avoid another RDH circulation.

With 4 bins [A,B,C,D] the normal bin loading and unloading sequence for copy pairs may (similarly to 3 bins) be: A,B;B,A;A,B; . . . (or, alternatively, A,B;A,B-;A,B; . . . ) until completion of the first two copy sets, then during the unloading and finishing of these first two copy sets, starting with the unloading of the first one completed (in A or B as the case may be), the next two copy sets may be made and loaded in the sequence C,D;D,C;C,D; . . .

Important features of the disclosed system include those whereby the desired dual flash is combined with a 3 (or 4) bin finisher to allow the finisher to support a high speed, high volume, copier, e.g., a more than 100 cpm system, at full productivity for even 3 sheet sets, while operating the staplers or stitchers at the same cyclic rate as a much slower system, such as for a precollation copier of half that speed. With the system here the RDH need only handle and recirculate documents at a document per minute repeat rate which is only one half the full copier rate in order to support the system. This has the very desirable provision of correspondingly increased available document acquisition and exchange times. Copy sets or books are compiled (accumulated, stacked or "staged") into the 3 bins, entering from one side of the bins and exiting another side (here the opposite sides in the processor paper movement direction). The finishing repeat rate may be reduced to once every 3 pitches for 3 sheet sets, or 4 pitches for 4 or more sheets.

A key feature of this system which enables this productivity is the sequential use of different pairs of the three compiler bins in coordination with finishing so that while the second of one pair of copy sheet sets is being removed from a bin and finished, the first two sheets of the next sequence or set are entering two other now empty and available bins, in a continuous enter one side/exit the other side sequential operation.

Another important disclosed feature is the use of the copier duplex tray to accumulate and stage multiple dual side one's (pairs of half finished duplex copy pair buffer sets) in the duplex tray. This system utilizes a modification of the system for plural single flash buffer sets disclosed in U.S. Pat. No. 4,278,344 to R. B. Sahay and other such references, supra. With the plural pairs buffer set system here (a) some inversions of duplex originals are avoided; and (b) small duplex document sets which otherwise could not repeat or recirculate through the RDH at the full rate of the copier without skipped pitches are flashed at the full rate. In this multiple dual side one's system, the documents are recirculated around the RDH loop path as if simplex copies were being made (i.e., without inversion) until a desired number of sets of side 1's are accumulated in the duplex tray appropriate to its desired (e.g. 100 sheets) or maximum total sheet capacity. E.g., copy sheets with odd document pages on one side are accumulated in the duplex buffer tray in the sequence N,N; N-2, N-2; . . . 3,3;1,1 repeated several times up to a maximum number of such buffer sheets desired, or a corresponding even page sequence, depending on the desired output inversion. The number of such plural buffer sets made consecutively will vary with the number of documents in the document set since that determines the size of each buffer set.

For a 3 flash closeout, described eleswhere herein, the duplex buffer tray may be loaded with buffer sets of N, N, N;N-2,N-2,N-2; . . . 3,3,3;1,1,1, providing the total number of buffer copies made this way does not exceed the maximum number desired there, in which case single flash closeout is made automatically.

The duplex documents are then inverted so that in subsequent circulations their side 2's are then copied, by repeating dual flashes, onto the backsides of the buffer sets from the duplex tray. In this way the RDH has only done one inversion of originals. Thus the RDH only has to perform one inversion cycle to copy up to, e.g., 100 sheets into the duplex tray, even for small document set sizes. Side 1 sets in the duplex tray are fed out and imaged on their other sides with dual side 2 image sets repeatedly until the duplex tray is emptied, and then the process can repeat, by a number of times depending on the number of copies required for the job. However, when sets of greater than about 50 sheets are encountered the staging of multiple sets in the duplex tray is no longer applicable.

This above plural paired buffer system allows duplex to duplex operation with multiple copies of even document sets as small as 3 sheets at the full rate of the copier despite an RDH inversion cycle rate for recirculation with inversion of such small document sets which would otherwise limit the output rate to 6/7ths of the full rate if dual copy sets were merely flashed in pairs with side 1's immediately following side 2's, i.e. with the duplex documents being inverted in each circulation.

Another important disclosed feature is that dual flash is replaced by triple flash on closeout of a job with an odd copy count. This added but compatible system avoids an extra single flash sequence which would have to be performed at half rate. This special case algorithm is actuated automatically by operator selection of an odd number of copies only for the final copying circulation of the set of originals. It avoids one entire RDH circulation in the case of an odd number of copies, and avoids the RDH rate of less than the copier rate from limiting productivity to the RDH rate, which it would if a single flash closeout was required for odd numbers of copy sets.

Also noted is an alternative system for an alternative 4 bin finisher, to similarly operate by providing a 4 flash closeout of even copy set jobs to similarly avoid another complete RDH circulation.

Another feature relates to the loading and feeding of inserts or special copy sheets, such as tabbed sheets, transparencies, chapter seperators, covers, etc. To utilize the normal dual flash operation here these special copy sheets are normally loaded in pairs into a paper feed tray different from the paper feed tray being used for regular copy sheets, and programmed to be alternatively fed to be copied to be in the appropriate positions in the copy sets. If these special sheet inserts differ from one another they are preferably loaded into their selected paper tray 46 or 47 in collated order. The controller "C" knows from its operator input when such special inserts are being used and can inhibit what would otherwise be run as a triple flash closeout, which would not feed the paired special sheets properly. If an odd number of copies has been selected, a single flash closeout can be used by purging one of the two special sheets into the tray 100 for example, rather than inserting it into a compiler bin.

If a jam occurs with special sheets being used, the entire module or set may have to be purged for job recovery to avoid getting the feeding of special sheets into the subsequent sets out of order.

There is an additional special case (other than odd set closeout of large duplex sets) in which single flash copying is used. This is for duplexing very large document sets, for either odd or even number of copies, where the duplex buffer tray capacity could be exceeded even for dual flash. In that case, *all* copies are made by single flash, not just those in the last circulation. The size of the copy set is estimated in advance of copying by (a) the operator input of whether the originals are simplex or duplex and (b), an estimate of the document set size from the height of the document stack, which is estimated by by a stack height sensor (e.g., U.S. Pat. No. 4,589,645 issued May 20, 1986 to M. J. Tracy or other art cited therein). The copy set and the duplex buffer set sizes correspond directly to the number of document pages (the sheet count for single documents and twice the sheet count for duplex documents). Thus, the controller can estimate in advance from the document stack height if the desired duplex buffer tray maximum capacity could be exceeded by dual flashing the documents, and automatically switch to single flash copying in that case.

An additional set recombination algorithm can be used for copy sets too large to individually fit into the bins, e.g., sets of more than 125 copy sheets. The bins can be loaded only up to their capacity and the partial sets then removed but not finished. The remaining or overload sheets from the uncompleted sets can be loaded into another bin, removed, and combined with the first parts of the sets to form complete copy sets (of up to 250 sheets in this example) which can then be finished and outputted.

Automatic collation of 1 to N instead of N to 1 document order presentation can be provided here within the same basic mechanical configuration for up to the number of available bins (3 or 4), i.e., if no more than 3–4 copies were keys in by the operator to be made. Documents can be loaded into the SADH input of the document handler in forward serial order (N−1). In that case, the copier can make 3 or 4 copies and the bins can be used to collate the output into the 3 or 4 copy sets. This is an ADF/sorter or post collation mode of operation, rather than precollation.

For a copier/duplicator product which has an RDH, duplex/duplex capability, and plural bin compiling, there are many possible flash sequences for running a job. However, for each case, there is only one sequence which optimizes productivity and minimizes the number of RDH or copy handling module (CHM) pauses and inversions. The machine logic selects the optimum operating sequence based on the modes selected, the number of originals, and the number of copy sets. The system will function in the simplex/simplex, simplex/-duplex, duplex/duplex and duplex/simplex modes, respectively.

For the following example, assume the CHM duplex tray 60 capacity is 100 sheets, the RDH tray 21 capacity is also 100 sheets, and the RDH set seperator, operating at the beginning of a job, can detect the approximate number of document sheets in the RDH tray.

Assume in this example that the set documents are duplex documents, and that duplex copies are being made, the most difficult case. The operator selects this mode and programs the number of copy sets. If the operator knows beforehand that there are more than 50 duplex originals in the stack, she/he may be given the option of either selecting single flash mode, which will run the job automatically but at half productivity, or she/he can manually seperate the document stack into smaller that 50 sheet stacks and run the job in several parts using the more productive dual flash mode. However, at the completion of the dual flash copy mode cycle, the stacked partial sets may need to be manually collated. This is because more than 50 duplex originals, if run in the dual flash mode, and duplex/duplex mode, would put more than 100 buffer copies in the duplex tray. Therefore, duplex copying jobs with more than 50 originals would exceed the assumed 100 sheet duplex tray capacity. Note that a single flash mode makes one copy for each two copier cycles or pitches whereas a dual or triple flash mode has no skipped pitches, except for certain special situations.

If the operator doesn't know how many originals are in the document set, she/he loads the RHD tray, pushes PRINT, and the set seperator operates to measure stack height. If it senses more than 100 sheets of simplex documents or 50 sheets of duplex documents, the machine can tell the operator (via the display) to run the job in smaller groups of sheets. If it senses fewer originals than that, it checks to see how many copy sets were required. If only one copy set was required, this job simply runs in single flash mode. If three duplex copy sets are required, it first checks to see if there are 33 or fewer originals. If there are, it runs the job in triple flash mode. This requires only two RDH circulations (for copying all of one side of the document set three times, turning it over, and copying the other sides three times each) and puts no more than 99 sheets in the duplex tray. If it senses more than 33 originals but less than 50, it runs the job by recirculating twice in dual flash mode, and twice more in single flash mode, to make the three duplex copy sets. In this manner, the 100 sheet duplex tray capacity is never exceeded. Finally, if either two copy sets, or 4 or more copy sets, are selected, it will run the job in dual flash mode if there are less than 50 duplex originals.

A similar logic flow occurs in simplex/simplex and simplex/duplex mode. However, if simplex rather than duplex copies are selected the capacity of the duplex buffer tray is not an operating constraint. With simplex/duplex the decision point re the number of originals will double, of course, because the simplex originals have half the number of pages per sheet, and they do not require inversion circulation.

To summarize, there is disclosed herein a system and algorithms for paper flow in copiers providing unlimited collated output with an RDH. It enables normally making two copies at a time at the maximum copying speed of a high speed copier from each original circulating in the RDH at a maximum original recirculation rate of one half that copying speed, thus maintaining full productivity of both the copier and the RDH. The copies are variably shunted into the bins of a 3-bin compiler of a finisher in such a way that one bin or another is available for copy set removal and finishing without interfering with continued copy sheet loading into the other two bins. The algorithms are extended to efficiently handle duplex and to handle odd-number copy counts. Features include dual flash, or copy pairs, loading of alternate 2 of 3 (or 4) bins, and a special finishing cycle with triple-flash close-out for odd numbers of copy sets (but single-flash close-out for large duplex odd numbered sets for which the capacity of the duplex buffer tray could be exceeded by triple-flash buffer sets).

It is important to note that in the system disclosed herein, that the three trays or bins of the finisher unit are NOT normally functioning as sorter or collator or stack bins. The copy sheets already leave the copier and enter the finisher unit precollated, in a page sequential order, albiet normally in interleaved adjacent pairs thereof, due to the RDH copying. Rather, two of said bins function to separately stack two precollated pairs at a time as they so emerge from the copier during the same time period as the other, third, bin serves as a waiting station holding a previously stacked completed copy set which is awaiting removal and finishing, and meanwhile another previously stacked and removed set is being finished in a single finisher. Normally all of this occurs continuously and repeated without any delay or pause in copying at the full copying rate of the copier.

While the embodiments disclosed herein are preferred, it will be appreciated from this teaching that various alternatives, modifications, variations or improvements therein may be made by those skilled in the art, which are intended to be encompassed by the following claims:

What is claim is:

1. An improved copying system for providing multiple precollated sets of copies from a recirculated set of documents, comprising:

document recirculation and copying means for pluraly recirculating a set of documents and normally making 2 (first and second) consecutive identical copies (copy sheets) therefrom per document per one said circulation of said document set, compiler means having only 3 or 4 compiler bins for sequentially accumulating and stacking copy sheets into completed compiled collated copy sheet sets in respective said compiler bins, removal means for removing said completed collated copy sheet sets from said compiler bins, copy sheet directing means for feeding and directing each of said 2 identical copy sheets separately into only 2 of said 3 or 4 compiler bins for one said copying circulation of the set of documents, and control means controlling said copy sheet directing means for sequentially changing, for subsequent circulations of the set of documents, which 2 of said compiler bins are so fed and are so accumulating said 2 identical copy sheets, and which other said compiler bin is not, said sequential changing occuring in coordination with said completions of accumulations of collated copy sheet sets, so that said removal means may remove an accumulated precollated set of copy sheets from at least one of said compiler bins while that compiler bin is not having a copy sheet fed thereinto, in coordination with and without interfering with said feeding and directing of other said copy sheets into other said compiler bins.

2. The copying system of claim 1 wherein there are only three said compiler bins in said compiler means, comprising first, second, and third compiler bins, and said copy sheet directing means are operated by said control means so that in one said circulation of the set of documents said first copies are accumulated in said first bin and said second copies are accumulated in said second bin and no copies are accumulated in said third bin; and so that for a subsequent said document set circulation said first copies are placed only in said second bin and said second copies are placed only in said third bin and a completed collated set of copies is removed from said first bin; and so that for another said subsequent document circulation said copies are placed only in said first and second bins again, and so that this sequencing is repeated until a selected total number of precollated sets of copies is produced.

3. The copying system of claims 1 or 2 wherein normally said copy sheet directing means and said control means feeds into the same compiler bin, in directly immediate sequence, said second copy of one document and said first copy of the next document, to reduce the number of operations of said copy sheet directing means.

4. The copying system of claim 3, wherein the set of documents to be so copied by said document recirculation and copying means is so circulated thereby at approximately one-half the rate of said copying of said documents, the copy sheets are fed and directed into one side of said compiler bins by said copy sheet directing means, and are removed from another side of said compiler bins by said removal means so that said copy sheet directing means and said removal means are not operating on the same sides of said compiler bins and not interfering with one another if the copies being made are duplex copies, and the number of documents in the document set would exceed a preset number corresponding to a maximum desired number of copy sheets in a duplex buffer tray, then said control means provides that only one copy is made of each document in each circulation of the document set and these copies are fed and directed into only one said compiler bin.

5. The copying system of claims 1 or 2 wherein, when there are an odd number of said documents in said document set, said document recirculation and copying means and said copy sheet directing means and said control means are operated to make three identical copies of each document in a final copying circulation of said document set and to feed and direct each of said 3 identical copy sheets separately into each of 3 said compiler bins.

6. The copying system of claims 1 or 2 wherein the set of documents to be so copied by said document recirculation and copying means is so circulated thereby at approximately one-half the rate of said copying of said documents.

7. The copying system of claims 1 or 2 wherein the sequences of feeding into and compiling copy sheets in said compiler bins and removing compiled collated copy sheet sets from said compiler bins of said compiler means comprises sequences substantially as follows; where "A", "B" and "C" are designations for the respective first, second and third compiler bins, where "N" is the designation of the first copy sheet to be fed into a compiler bin of a total of N copy sheets in a collated copy sheet set to be compiled therein, where "1" is the last fed copy sheet of that copy set, where "- - -" represents the repetition and continuation of the associated sequence "N" to "1" between said first and last copy sheets of that sequence for that copy set, and where "{EJECT→}" represents the removing of that completed compiled collated copy set from that respective compiler bin by said removal means:

```
C
B          _N_  _N-1_  ---
A  _N_                  _N-1_  ---
C
B  ---     _2_  _1_ {EJECT→}
A  ____2_                _1_ {EJECT→}
C          _N_  ---  _1_ {EJECT→}
B  _N_  ---  _1_ {EJECT→}
A.
```

8. The copying system of claims 1 or 2 wherein the copy sheets are fed and directed into one side of said compiler bins by said copy sheet directing means, and are removed from another side of said compiler bins by said removal means so that said copy sheet directing means and said removal means are not operating on the same sides of said compiler bins and not interferring with one another.

9. The copying system of claims 1 or 2 wherein if the copies being made are duplex copies, and an odd number of copy sets are selected to be made from the document set, and three times the number of documents in the document set would exceed a preset number corresponding to a maximum desired number of copy sheets in a duplex buffer tray, then on the the final copying circulation of the document set said control means provides that only one copy is made of each document and these copies are fed and directed into only one said compiler bin.

10. The copying system of claims 1 or 2 wherein if the copies being made are duplex copies, and the number of documents in the document set would exceed a preset number corresponding to a maximum desired number of copy sheets in a duplex buffer tray, then said control means provides that only one copy is made of each document in each circulation of the document set and these copies are fed and directed into only one said compiler bin.

11. An improved copying method for providing multiple precollated sets of copies from a mulitply recirculated set of documents, comprising:

normally making 2 (first and second) consecutive identical copies (copy sheets) per document per circulation of said document set, feeding and directing each of said 2 identical copy sheets seperately into only 2 of only 3 compiler bins per said copying circulation of the set of documents, sequentially accumulating and stacking said copy sheets into two completed compiled collated copy sheet sets in said two compiler bins, removing one said completed collated copy sheet sets from one said compiler bin without interfering with said feeding and directing of other said copy sheets into two other said compiler bins, and wherein said three compiler bins comprise first, second, and third compiler bins, and in one said circulation of the set of documents said first copies are accumulated in said first bin and said second copies are accumulated in said second bin and no copies are accumulated in said third bin and for a subsequent said document set circulation said first copies are placed only in said second bin and said second copies are placed only in said third bin and a completed collated set of copies is removed from said first bin and for another said subsequent document circulation said copies are placed only in said first and second bins again, and this sequencing is repeated until a selected total number of precollated sets of copies is produced.

12. The copying method of claim 11 wherein normally said second copy of one document and said first copy of the next document feed into the same compiler bin, in directly immediate sequence, to reduce the number of operations of copy sheet directing.

13. The copying method of claims 11 or 12 wherein, when there are an odd number of said documents in said document set, three identical copies are made of each document in a final copying circulation of said document set and fed separately into each of 3 said compiler bins.

14. The copying method of claims 11 or 12 wherein the set of documents being copied is circulated at approximately one-half the rate of copying of said documents.

15. The copying method of claims 11 or 12 wherein the copy sheets are fed into one side of said compiler bins, and are removed from the opposite side of said compiler bins, so that said copy sheet accumulating and said copy set removing are occuring simultaneously from opposite sides of said compiler bins without interferring with one another.

16. The copying method of claims 11 or 12 wherein if the copies being made are duplex copies, and the number of documents in the document set would exceed a preset number corresponding to a maximum desired number of copy sheets in a duplex buffer tray, then only one copy is made of each document in each circulation of the document set and these copies are fed and directed into only one said compiler bin.

17. The copying method of claim 16 wherein if the copies being made are duplex copies, and if the number of documents in the document set does not exceed a preset maximum desired number, then plural pairs of one-sided buffer set copies are repeatedly made from one side of the documents and placed in a duplex buffer tray and then copied on their other sides from the other sides of the documents.

18. The copying method of claims 11 or 12 wherein while one completed and removed copy set is being finished, as by glue binding or the like, another copy set remains in one compiler bin waiting to be removed and finished while two other copy sets are being made and accumulated in the other two compiler bins.

19. An improved copying method for providing multiple collated copy sets from a multiply recirculated set of documents copied in precollated page sequential order in a copier, comprising normally making immediately sequential pairs of identical copies of each document in said precollated order and sequentially feeding them into an associated three bin finishing unit in precollated page sequential order; and normally stacking one of said pair of copies in one bin and the other in another bin; and, during the same time period, holding a previously stacked complete copy set, which is awaiting removal and finishing, in the other, third, bin, which is then serving as a buffer or waiting station; and meanwhile finishing another previously stacked and removed copy set in an associated set finisher; and alternating which bin so serves as said buffer or waiting station, and which two bins are so fed copy sheets for stacking, in coordination with said recirculations of the set of documents.

20. The improved copying method of claim 19, wherein all said steps occur continuously and repeatedly without any delay or pause in copying at the full copying rate of the copier, and the set documents are recirculated at one-half the full copying rate of the copier.

21. In a specialized copying system for producing multiple finished collated copy sets by repeatedly generating copies in a copier in sequential page order sets, but normally generating two, and only two, identical copies per page at a time irrespective of the number of said multiple copy sets being made, and feeding said sequential page order pairs of copies separately to two bins of a finisher unit for removal therefrom and finishing of completed collated copy sets, the improvement for copying and finishing said collated copy sets at up to the full copying rate of the copier, comprising:

a movable bin unit with only three or four bins;

a single set removal means for removing a completed copy set for finishing from a bin which is adjacent said set removal means;

bin indexing means for indexing said movable bin unit so that said one side of a selected varying one of said three or four bins is positioned adjacent said set removal means; and bin loading and control means for sequentially feeding said copies into a selected, varying, pair of said bins, other than a bin from which a completed copy set is being removed, and from a different side of said bins, said bin loading means so feeding said copies into said selected pair of bins while another bin is awaiting or undertaking removal of a copy set by said set removal means, or while a copy set previously removed from another bin is being finished, or while said movable bin unit is being indexed by said indexing means, to avoid interruption of said generating of copies and said bin loading thereby.

22. The copying system of claim 21 wherein said copy sets are so generated by recirculating a set of documents in a recirculating document handler at a recirculation rate which is half of said full copying rate.

23. The copying system of claim 21 wherein said movable bin unit indexes vertically, said bin loading means moves said copy sheets vertically past one side of said bins and selectively deflects individual sheets into selected bins, and said set removal means moves substantially horizontally at one vertical level to remove copy sets from a bin indexed to said one vertical level.

24. In a specialized copying method for producing multiple finished collated copy sets by repeatedly generating copies in a copier in sequential page order sets, but normally generating two, and only two, identical copies per page at a time irrespective of the number of said multiple copy sets being made, and feeding said sequential page order pairs of copies separately to two bins of a finisher unit for removal therefrom and finishing of completed collated copy sets, the improvement for copying and finishing said collated copy sets at up to the full copying rate of the copier, comprising:

feeding all said copies to a movable bin unit with only three or four bins;

removing a completed copy set for finishing from a bin at one position of one side of a bin;

indexing said movable bin unit so that said one side of a selected varying one of said three of four bins is positioned adjacent said one position; and sequentially feeding said copies into a selected, varying, pair of said bins other than a bin containing a completed copy set which has not yet been removed, and from a different side of said bins than the side from which a completed copy set is being removed;

so feeding said copies into said selected pair of bins while another bin is awaiting or having removal of a copy set, or while a copy set previously removed from another bin is being finished, or while said movable bin unit is being indexed, to avoid interruption of said generating of copies and said bin loading thereby.

25. The copying method of claim 24 wherein said copy sets are so generated by recirculating a set of documents in a recirculating document handler at a recirculation rate which is half of said full copying rate.

26. The copying method of claims 24 or 25 wherein said movable bin unit index vertically, said copy sheets are moved vertically past one side of said bins and selectively deflected into said selected bins, and said completed copy set are removed substantially horizontally at one vertical level from a bin indexed to said one vertical level.

* * * * *